US008978912B1

(12) United States Patent
Kraeling

(10) Patent No.: US 8,978,912 B1
(45) Date of Patent: Mar. 17, 2015

(54) COLLAPSIBLE SHIPPING TOTE

(71) Applicant: Response Holdings Corporation, Greenville, SC (US)

(72) Inventor: Brett B. Kraeling, Simpsonville, SC (US)

(73) Assignee: Response Holdings Corporation, Greenville, SC (US)

( * ) Notice: Subject to any disclaimer, the term of this patent is extended or adjusted under 35 U.S.C. 154(b) by 63 days.

(21) Appl. No.: 13/785,759

(22) Filed: Mar. 5, 2013

Related U.S. Application Data

(60) Provisional application No. 61/612,700, filed on Mar. 19, 2012.

(51) Int. Cl.
*B65D 6/16* (2006.01)
*B65D 6/18* (2006.01)
*B23P 11/00* (2006.01)

(52) U.S. Cl.
CPC .. *B65D 7/26* (2013.01); *B23P 11/00* (2013.01)
USPC ..... 220/7; 220/4.28; 220/666; 220/520; 220/531; 229/120.31

(58) Field of Classification Search
USPC ..... 220/7, 4.01, 4.08, 4.28, 6, 666, 668, 220/9.1, 9.2, 520, 528, 529, 531; 206/600, 206/577, 139, 545, 549; 229/136, 120.19, 229/120.21, 120.31, 930, 931
See application file for complete search history.

(56) References Cited

U.S. PATENT DOCUMENTS 338,094 A * 3/1886 Martin ..... 217/18
901,858 A * 10/1908 Williams ..... 229/117.06
1,126,246 A * 1/1915 Maier ..... 229/196
1,971,863 A * 8/1934 Lupton ..... 229/117.06
2,485,028 A * 10/1949 Bauernfreund et al. ..... 220/6
3,029,711 A * 4/1962 Griese ..... 493/90
3,195,481 A 7/1965 Verguin
3,201,022 A * 8/1965 Glassco et al. ..... 229/120.24
3,217,771 A * 11/1965 Skirow et al. ..... 206/426
3,527,339 A * 9/1970 Cipolla ..... 206/290
3,628,718 A * 12/1971 Broyles ..... 229/120.37
3,628,842 A * 12/1971 Wright ..... 312/259
3,850,295 A 11/1974 Black
4,034,909 A * 7/1977 Toda ..... 229/117
4,050,604 A 9/1977 Flanders
4,333,602 A * 6/1982 Geschwender ..... 229/125.39

(Continued)

FOREIGN PATENT DOCUMENTS

EP 0 883 551 4/2008

*Primary Examiner* — Bryon Gehman
*Assistant Examiner* — Gideon Weinerth
(74) *Attorney, Agent, or Firm* — Womble Carlyle Sandridge & Rice, LLP

(57) ABSTRACT

A body of a collapsible shipping tote extends around an interior space of the tote while erected. The body has a series of body panels that are respectively foldably connected to one another so that the body can be reconfigured between the erected configuration and a collapsed configuration. The tote has end assemblies that each have an end panel and flaps respectively foldably connected to edges of the end panel. Each of the end assemblies is configured for being moved between an open configuration for opening a respective end of the body while the body is in the erected configuration, and a closed configuration for closing the respective end of the body while the body is in the erected configuration. Fasteners releasably secure the flaps to the body for releasably securing the body in the erected configuration.

25 Claims, 11 Drawing Sheets

(56) References Cited

U.S. PATENT DOCUMENTS

D275,819 S * 10/1984 Leiserson ..... D3/267
4,550,830 A 11/1985 Shuert
4,610,286 A * 9/1986 Cyr ..... 206/316.2
4,643,314 A 2/1987 Kidd
4,673,087 A 6/1987 Webb
4,676,373 A 6/1987 Schneider
4,703,702 A 11/1987 Speicher
4,756,469 A * 7/1988 Hansen ..... 229/120.25
4,765,252 A 8/1988 Shuert
4,785,957 A 11/1988 Beck et al.
4,801,079 A * 1/1989 Gonella ..... 229/174
4,809,851 A 3/1989 Oestreich, Jr. et al.
4,884,935 A * 12/1989 Smith et al. ..... 414/498
4,936,451 A 6/1990 Shuert
4,948,039 A * 8/1990 Amatangelo ..... 229/198
4,951,867 A * 8/1990 McManus ..... 229/120.31
4,969,567 A 11/1990 Rogers
5,056,666 A 10/1991 Janssens
5,109,985 A 5/1992 Rose
5,133,460 A 7/1992 Shuert
5,136,119 A * 8/1992 Leyland ..... 174/379
5,167,363 A * 12/1992 Adkinson et al. ..... 229/120.31
5,180,075 A * 1/1993 Montalbano ..... 229/103.11
5,190,179 A 3/1993 Richter et al.
5,251,753 A 10/1993 Pigott et al.
5,279,423 A 1/1994 Shuert
5,356,014 A 10/1994 Berner
5,441,154 A 8/1995 Youell, III
5,445,396 A 8/1995 Sebor
5,487,471 A 1/1996 Marchek et al.
5,525,026 A 6/1996 DeMonte et al.
5,545,844 A * 8/1996 Plummer et al. ..... 174/379
5,555,980 A 9/1996 Johnston et al.
5,558,242 A 9/1996 Kuan
5,564,599 A 10/1996 Barber et al.
5,601,202 A 2/1997 Meacham et al.
5,609,111 A 3/1997 Hasegawa et al.
5,651,463 A 7/1997 Major et al.
5,725,119 A 3/1998 Bradford et al.
5,732,531 A * 3/1998 de Silva et al. ..... 53/416
5,794,542 A 8/1998 Besaw
5,799,812 A 9/1998 Mansouri
5,815,903 A * 10/1998 Foster et al. ..... 29/401.1
5,826,721 A 10/1998 Fujimoto et al.
5,829,595 A 11/1998 Brown et al.
5,836,255 A 11/1998 Uitz
5,842,571 A * 12/1998 Rausch ..... 206/549
5,881,895 A * 3/1999 Linnell ..... 220/4.28
5,906,290 A * 5/1999 Haberkorn ..... 220/505
6,021,916 A 2/2000 Stolzman
6,045,037 A * 4/2000 McGeehin ..... 229/125.39
6,062,410 A 5/2000 Bradford et al.
D430,316 S * 8/2000 Guertin ..... D25/199
6,105,804 A 8/2000 Stoffer
6,155,181 A 12/2000 Chilcutt
6,161,715 A 12/2000 Stolzman
6,196,449 B1 * 3/2001 Chen ..... 229/120.31
6,223,922 B1 * 5/2001 Amatangelo ..... 220/6
6,230,916 B1 5/2001 Bradford et al.
6,238,091 B1 * 5/2001 Mogil ..... 383/110
6,266,972 B1 7/2001 Bostic
6,389,990 B1 5/2002 Apps
6,471,065 B1 * 10/2002 Peeples et al. ..... 206/545
6,497,542 B1 12/2002 Vermeulen
6,648,142 B1 11/2003 Hugenholz et al.
6,668,735 B2 12/2003 Cassina
6,679,378 B1 1/2004 Vermeulen et al.
6,702,180 B2 * 3/2004 Hsu ..... 229/120.28
6,726,041 B2 4/2004 Dunn
6,837,377 B2 1/2005 Shuert
6,910,560 B2 * 6/2005 Dulin ..... 190/109
6,966,449 B2 11/2005 Williams
7,011,224 B2 * 3/2006 Sheng-Bin ..... 220/6
7,234,630 B2 * 6/2007 Wang ..... 229/120.31
7,316,344 B2 * 1/2008 Smith ..... 229/198.1
7,624,886 B2 * 12/2009 Huang ..... 220/6
7,779,976 B2 * 8/2010 Mangano ..... 190/110
D625,922 S * 10/2010 Rees et al. ..... D3/304
7,938,084 B2 * 5/2011 Scott et al. ..... 119/65
8,033,405 B2 * 10/2011 Wang ..... 211/118
8,033,448 B2 * 10/2011 Breitfeld et al. ..... 229/120.28
8,281,950 B2 * 10/2012 Potts et al. ..... 220/531
2003/0080125 A1 * 5/2003 Cassani ..... 220/6
2003/0150757 A1 8/2003 Dunn
2004/0168946 A1 9/2004 Angeletti et al.
2004/0188307 A1 9/2004 Beck
2004/0195127 A1 10/2004 Beck
2004/0232021 A1 11/2004 Linton
2005/0067474 A1 * 3/2005 Wang ..... 229/117.35
2005/0284906 A1 * 12/2005 Potts et al. ..... 224/539
2007/0025647 A1 * 2/2007 Hamlin ..... 383/14
2007/0200470 A1 * 8/2007 Wang ..... 312/6
2008/0110969 A1 * 5/2008 Wang ..... 229/125.01
2008/0190922 A1 * 8/2008 Kraeling ..... 220/6
2008/0283535 A1 * 11/2008 Westrate et al. ..... 220/529
2010/0193512 A1 * 8/2010 Heselden ..... 220/6
2011/0011856 A1 * 1/2011 Rothschild et al. ..... 220/7
2011/0168598 A1 * 7/2011 Rees et al. ..... 206/505
2011/0272401 A1 * 11/2011 Tarsia ..... 220/9.2
2012/0000912 A1 * 1/2012 Potts et al. ..... 220/553
2012/0145708 A1 * 6/2012 Wall et al. ..... 220/7
2012/0168434 A1 * 7/2012 Alagarda Cervera et al. ..... 220/4.33
2012/0267366 A1 * 10/2012 Wang ..... 220/7
2013/0043241 A1 * 2/2013 Hunter ..... 220/6
2013/0048633 A1 * 2/2013 Wang ..... 220/6
2014/0319132 A1 * 10/2014 Ram ..... 220/7

* cited by examiner

COLLAPSIBLE SHIPPING TOTE

CROSS-REFERENCE TO RELATED APPLICATION

This application claims the benefit of U.S. Provisional Application No. 61,612,700, filed Mar. 19, 2012.

INCORPORATION BY REFERENCE

The entire disclosure of U.S. Provisional Application No. 61,612,700, filed Mar. 19, 2012, is incorporated herein by reference.

FIELD OF THE INVENTION

The present invention is generally related to collapsible shipping containers and, more specifically, to collapsible shipping totes.

BACKGROUND

It is known for shipping containers to be used in shipping components to manufacturers, and then for the shipping containers to be collapsed and returned to be reused in shipping additional components. Preferably 100% of the containers are returned for reuse, but it is common for return ratios to be less than 100% for a wide variety of reasons.

Whereas a variety of shipping containers are known, there is always a desire for improved shipping containers that are efficient to make and use, durable, lightweight, and seek to provide high return ratios.

SUMMARY

One aspect of this disclosure is the provision of a collapsible shipping tote. Very generally described, the tote may have a generally tubular body for extending around an interior space of the tote while the body is in an erected configuration. The body may have body panels that are respectively foldably connected to one another, so that the body can be reconfigured between the erected configuration and a collapsed configuration.

In one embodiment of this disclosure, the shipping tote has end assemblies that each have an end panel and one or more flaps foldably connected to respective edges of the end panel. Each of the end assemblies may be configured for being moved between open and closed configurations. In its closed configuration, each of the end assemblies at least partially closes a front and rear end of the erected body. In contrast, while each of the end assemblies is in its open configuration, the respective end of the erected body is at least partially open.

Fastener parts may be respectively mounted to the flaps and corresponding portions of the body for releasably securing the flaps to the body so that the end assemblies releasably securing the body in the erected configuration. For example, the fasteners may be hook-and-loop fasteners, such that the fastener parts are strips of textile material respectively comprising hooks and loops. These strips of textile material may be respectively sewn to the body and flaps.

Optionally, at least one divider panel may be positioned in the interior space of the tote and foldably connected to the tubular body for dividing the interior space into cells that are open at both of the opposite front and rear ends of the erected body while the end assemblies are open. In one embodiment, each of the panels comprises at least one piece of textile material and a stiffening panel that are at least partially secured to one another by way of one or more sewn seams. For example, a stiffening panel may be contained within a pocket formed by sewing textile material and/or a stiffening panel and textile material may be sewn directly together. Similarly, connections between the body panels, and between the divider panel(s) and the body, may be provided by one or more sewn seams. Optionally, one of the flaps of each end assembly may be sewn to the body.

The erected totes may be used, for example, in shipping components to manufacturers, and then the totes may be collapsed and returned to be reused in shipping additional components. For example, the components may be loaded and unloaded through front ends of the totes. As a result, the totes may be conveniently used, for example, in association with flow through supply racks on assembly lines. The totes may be used in any other suitable manner.

In one aspect, a substantial portion of each shipping tote is constructed of sewn textile material, so the totes may be lightweight, and their designs may be easily customized to accommodate different components to be shipped.

The foregoing presents a simplified summary of some aspects of this disclosure in order to provide a basic understanding. The foregoing summary is not extensive and is not intended to identify key or critical elements of the invention or to delineate the scope of the invention. The purpose of the foregoing summary is to present some concepts of this disclosure in a simplified form as a prelude to the more detailed description that is presented later. For example, other aspects will become apparent from the following.

BRIEF DESCRIPTION OF THE DRAWINGS

Having described some aspects of this disclosure in general terms, reference will now be made to the accompanying drawings, which are schematic and not necessarily drawn to scale. The drawings are exemplary only, and should not be construed as limiting the invention.

DETAILED DESCRIPTION

Exemplary embodiments of this disclosure are described below and illustrated in the accompanying figures, in which like numerals refer to like parts throughout the several views.

The embodiments described provide examples and should not be interpreted as limiting the scope of the invention. Other embodiments, and modifications and improvements of the described embodiments, will occur to those skilled in the art and all such other embodiments, modifications and improvements are within the scope of the present invention. For example, it will be apparent to those skilled in the art that features illustrated or described as part of one embodiment may be used in another embodiment to yield a further embodiment, and that these further embodiments are within the scope of the present invention.

Figure 1:
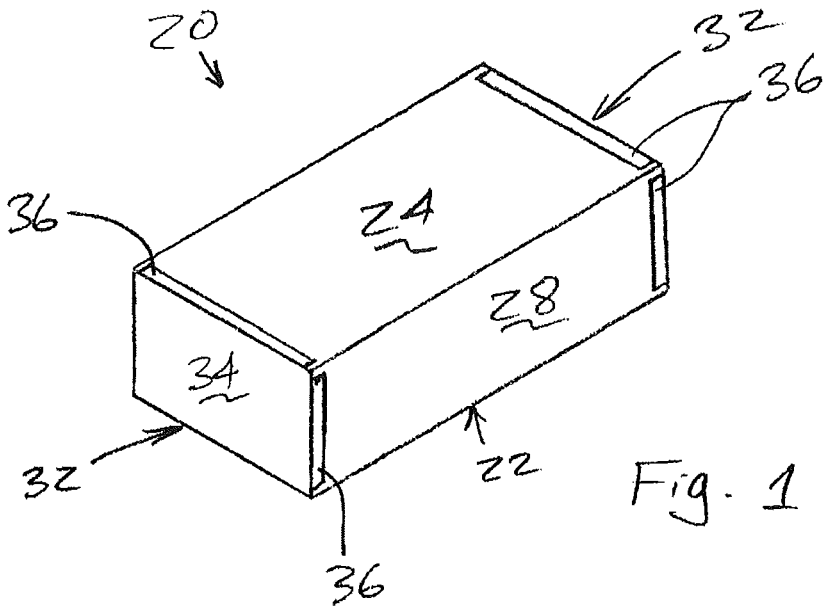
FIG. 1 is a top, front, right pictorial view of a shipping tote in an erected configuration with its ends closed, in accordance with a first exemplary embodiment of this disclosure.
Figure 2:
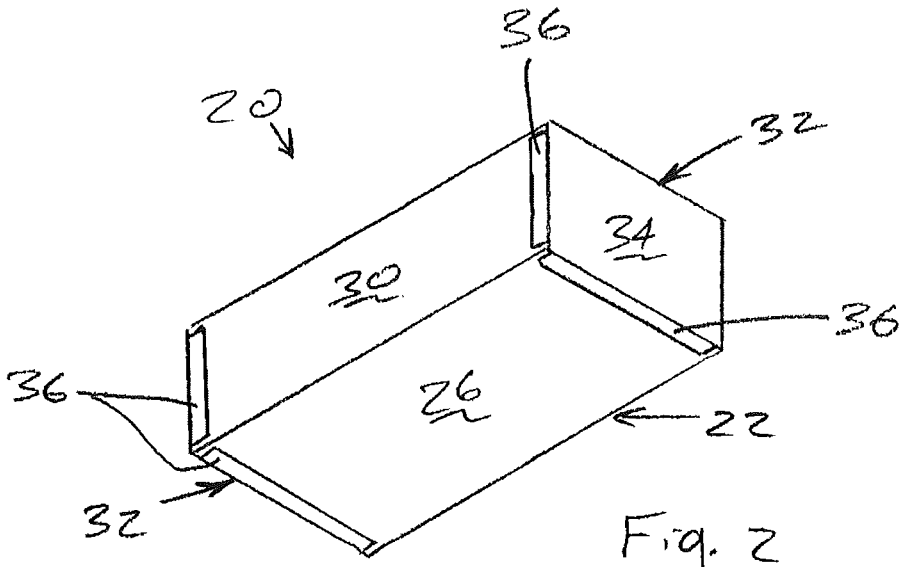
FIG. 2 is a bottom, rear, left pictorial view of the erected shipping tote of FIG. 1 with its ends closed.
Figure 3:
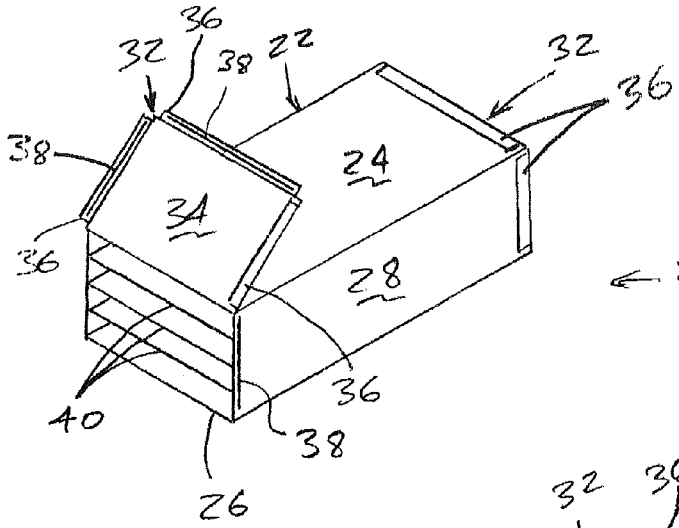
FIG. 3 is like FIG. 1, except that the front end of the shipping tote is open.
Figure 4:
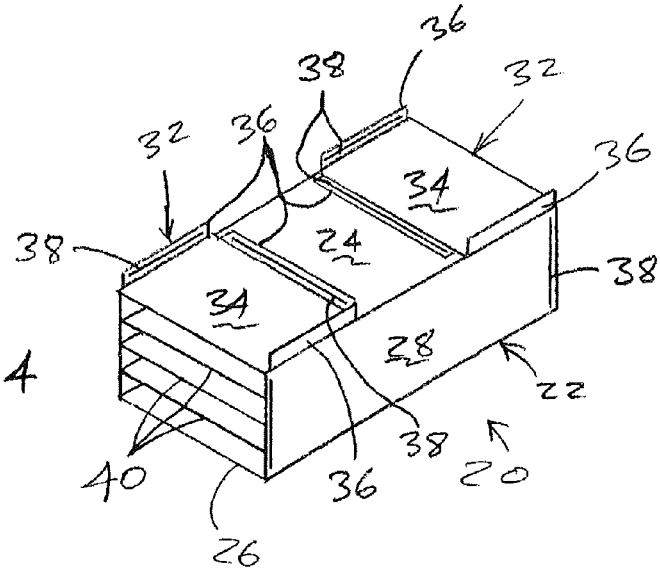
FIG. 4 is generally like FIG. 3, except that the rear end of the shipping tote is also open.

FIGS. 1 and 2 show an erected shipping tote 20 with its opposite front and rear ends closed, in accordance with a first exemplary embodiment of this disclosure. The exterior of the erected tote 20 with closed ends is generally or substantially in the form of a rectangular parallelepiped, although differently shaped totes are within the scope of this disclosure. FIG. 3 shows the erected tote 20 with one end open, and FIG. 4 shows it with both ends open.

The tote 20 includes a generally tubular body 22 that extends around an interior space of the tote while the body/tote is erect. The body 22 includes top, bottom, right and left body panels 24, 26, 28, 30 that are respectively foldably connected to one another, as will be discussed in greater detail below.

The tote 20 further includes front and rear end assemblies 32 for opening and closing (e.g., at least partially or substantially closing) the front and rear ends of the tote. When closed, the end assemblies 32 cooperatively provide, or serve as, structure for holding the tote 20 in its erected configuration. Each end assembly 32 has an end panel 34 and flaps 36 foldably connected to the edges of the end panel, as will be discussed in greater detail below. Each of the end assemblies 32 is configured for being moved between open and closed configurations. In its closed configuration, each of the end assemblies 32 at least partially closes a respective end of the erected body 22. In contrast, while each of the end assemblies 32 is in its open configuration, the respective end of the erected body 22 is at least partially open. In the first exemplary embodiment, the empty erected body will collapse under its own weight as soon as/in response to both of the end assemblies 32 being opened, and the tote 20 is shown in its collapsed configuration in FIG. 5.

In the exemplary embodiment, fastener parts are respectively mounted to the flaps 36 and corresponding portions of the body 22 for releasably securing the flaps to the body and, thus, releasably securing the body in the erected configuration. For example, the fasteners may be hook-and-loop fasteners, such that the fastener parts are fastener strips 38 of textile material respectively comprising hooks and loops. The fastener strips 38 of textile material in and of themselves are conventional, and as an example such fasteners are available as Velcro® hook and loop fasteners. For reasons of convenience, in this disclosure the reference number 38 is used for designating both fastener strips comprising hooks and fastener strips comprising loops.

Notwithstanding, those of ordinary skill in the art will understand that when a pair of fastener strips 38 forms a fastener, typically one of the fastener strips comprises hooks and the other of the fastener strips comprises loops. The fastener strips 38 may be respectively sewn to the body 22 and flaps 36, as will be discussed in greater detail below. Other types of fasteners may be used, such as, but not limited to, conventional snaps, conventional buttons, or any other suitable fasteners. In addition, the flaps 36 may be characterized as being portions of the fastener mechanisms, and the flaps may be omitted if the selected fasteners do not require the flaps for operability.

Referring to FIGS. 3 and 4, divider panels 40 are positioned in the interior space of the tote 20 and foldably connected to the body 22 for dividing the interior space into cells that are each open at both of the opposite ends of the erected body while the end assemblies 32 are open.

The length of the tote 20 may be longer or shorter than its width. Irrespective, a longitudinal direction may be characterized as extending from the front to the rear end of the body 22, or vice versa, so that the opposite front and rear ends of the body are spaced apart from one another in a longitudinal direction. Accordingly, the divider panels 40 each extend in the longitudinal direction and in a direction crosswise to the longitudinal direction. As shown in FIGS. 3 and 4, the crosswise direction extends substantially horizontally.

Figure 6:
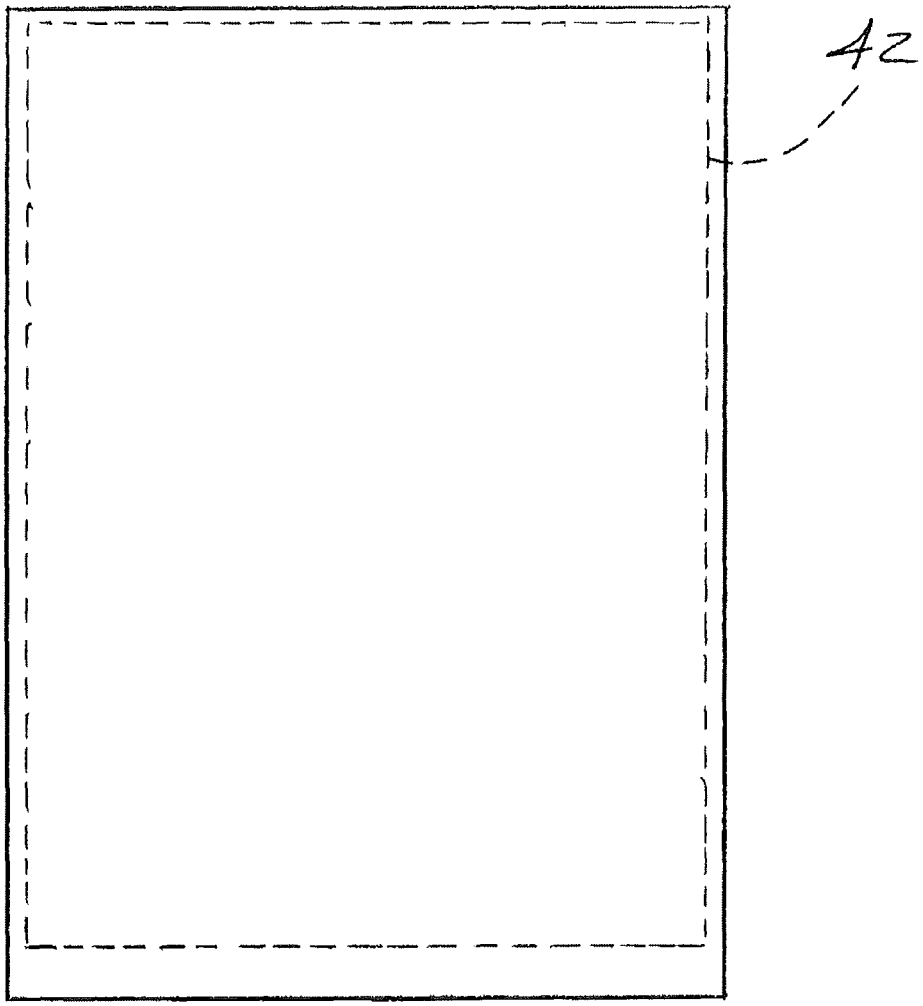
FIG. 6 is an isolated view that is generally representative of each of the body and divider panels of the tote of FIG. 1.
Figure 10:
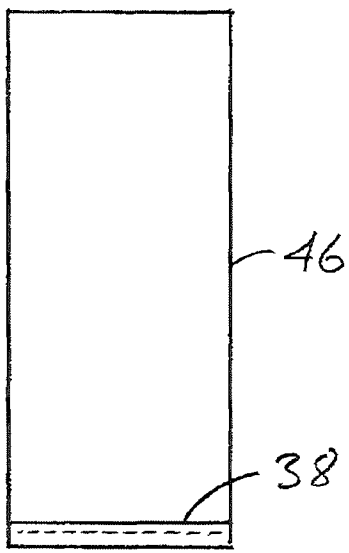
FIGS. 9 and 10 respectively are isolated plan views of outer and inner sides of an inner piece of the representative body panel showing fastener strips attached thereto by sewn seams, in accordance with the first exemplary embodiment.
Figure 9:
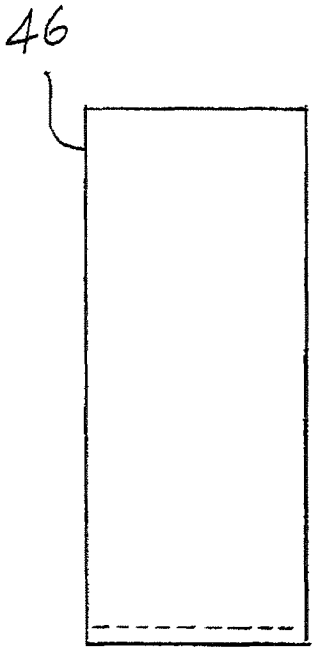

Referring generally to the representative panel schematically shown in FIG. 6, each of the body and divider panels 24, 26, 28, 30, 40 is a multi-part panel comprising a stiffening panel 42 that is typically inserted into and substantially fully enclosed within a chamber or pocket formed of textile material. In this regard, in FIG. 6, the solid lines are illustrative of the periphery of a representative one of the pockets of the panels 24, 26, 28, 30, 40, and the dashed lines are schematically illustrative of a stiffening panel 42 hidden from view within the substantially closed pocket. As more specific examples and using the frame of reference of FIG. 3, FIG. 6 is generally schematically illustrative of both top and bottom plan views of each of the divider panels 40, top body panel 24 and bottom body panel 26. Similarly, FIG. 6 is generally schematically illustrative of both right and left elevation views of the right and left body panels 28, 30. Seams and fastener strips 38 are omitted from FIG. 6 for ease of understanding.

Figure 5:
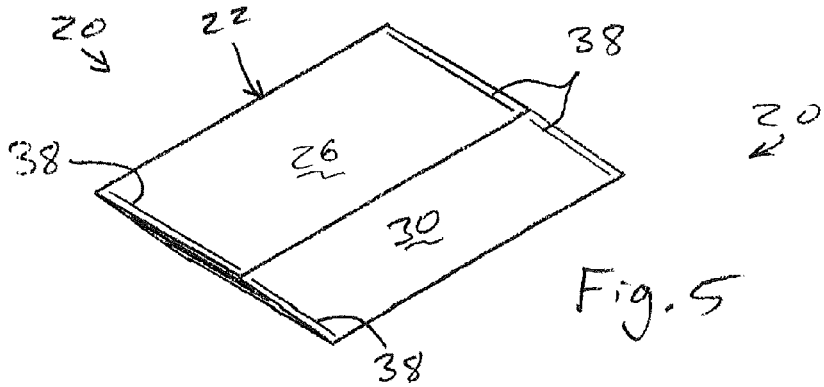
FIG. 5 is bottom view of the shipping tote of FIG. 1 in a collapsed configuration.

The foldable connections of the divider panels 40 to the body 22 and the body panels 24, 26, 28, 30 to one another are cooperatively configured so that, while the end assemblies 32 are open as shown in FIG. 4, the tote 20/body 22 can be transitioned from the erected configuration to the collapsed configuration shown in FIG. 5, and the tote/body can be reconfigured between the erected and collapsed configurations numerous times. In this regard, the end assemblies 32 may be fully removed from the body 22 preparatory to achieving the collapsed configuration, or more preferably (e.g., optionally) the upper flaps 36 may respectively remain connected to the opposite ends of the top body panel 24 in the collapsed configuration. In this regard, FIG. 5 may be described as showing the tote 20 in a collapsed configuration in which the upper flaps 36 are connected to the opposite ends of the top body panel 24, wherein the tote has been turned over and the flaps have been folded under and concealed beneath the body 22.

In an example of a method of using the tote 20, erected totes may be used in shipping components to manufacturers, and then the totes may be collapsed and returned to be reused in shipping additional components. For example, the components may be loaded and unloaded through front ends of the totes 20 configured as shown in FIG. 3. As a result, the totes 20 may be conveniently used, for example, in association with flow through supply racks on assembly lines. The components may be shipped within the erected totes 20 as shown in FIGS. 1 and 2. After unloading contents through an open end of the tote 20 as shown in FIG. 3, the opposite ends of the totes 20 may be opened as shown in FIG. 4, and the totes may be collapsed as shown in FIG. 5. However, the totes 20 may be used in a wide variety of other manners.

An example of a suitable method for forming the tote 20 is described in the following, in accordance with the first exemplary embodiment, although the tote may be assembled in any other suitable manner. Very generally described, the tote 20 may be manufactured by cutting pieces of textile material to size, respectively sewing the fastener strips to the pieces of textile material, and then sewing the pieces of textile material together in a predetermined manner, wherein stiffening panels are incorporated into the process at a predetermined time, as will be discussed in greater detail below.

Figure 8:
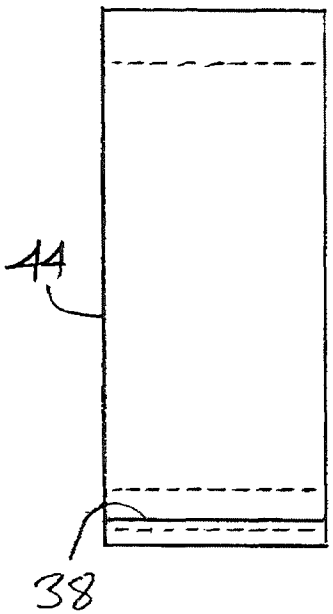
FIGS. 7 and 8 respectively are isolated plan views of outer and inner sides of an outer piece of a body panel showing fastener strips attached thereto by sewn seams, in accordance with the first exemplary embodiment.
Figure 7:
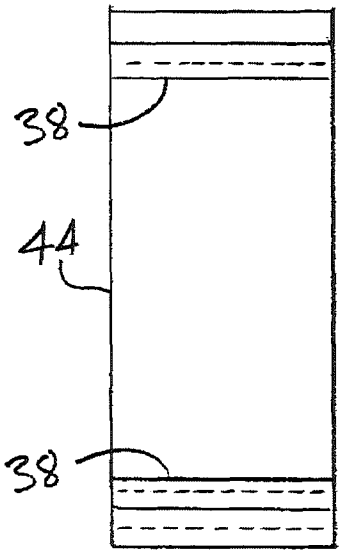
Figure 11:
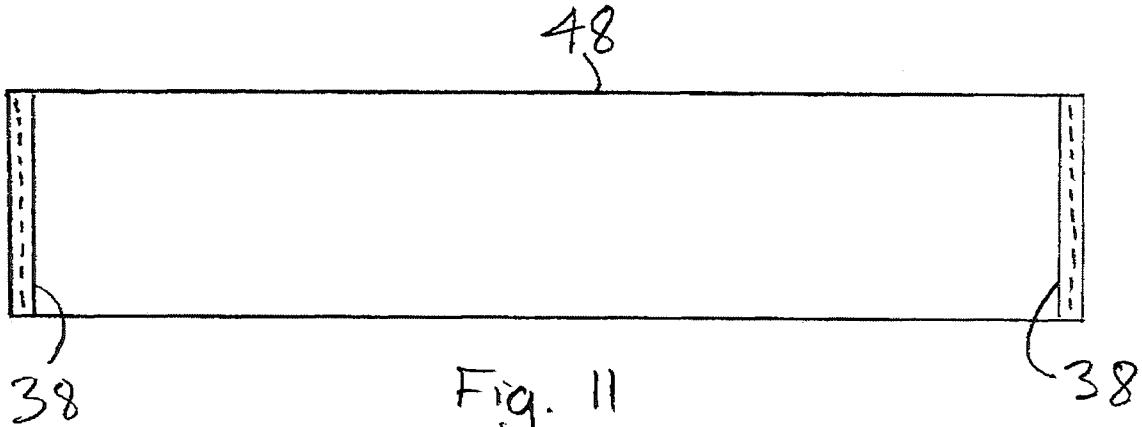
FIG. 11 is an isolated plan view of an inner side of a piece of a representative divider panel showing fastener strips attached thereto by sewn seams, in accordance with the first exemplary embodiment.

Referring more specifically to FIGS. 7-11, textile material pieces 44, 46, 48 are cut to size, and fastener strips 38 are respectively attached to the textile material pieces, such as by sewing. Each of the body panels 24, 26, 28, 30 may be generally the same. FIGS. 7 and 8 respectively are isolated views of outer and inner sides of a representative outer piece 44 of a representative body panel showing fastener strips 38 attached thereto by lateral sewn seams. Similarly, FIGS. 9 and 10 respectively are isolated views of outer and inner sides of an inner piece 46 of the representative body panel showing a fastener strip 38 attached thereto by a lateral sewn seam. FIG. 11 is an isolated plan view of an inner side of a textile material piece 48 of a representative divider panel 40 showing fastener strips 38 attached thereto by lateral sewn seams.

In accordance with the first exemplary embodiment, each of the pieces 44, 46, 48 is a piece of textile material, or more specifically a material that comprises fabric. The outer and inner pieces 44, 46 of the body panels 24, 26, 28, 30 may each be a different type of textile material, with the outer piece 44 being selected with a relatively high emphasis on durability, and the inner piece 46 being selected with a relatively high emphasis on being non-abrasive for protecting the components being shipped in the tote 20.

In some of the drawings of this disclosure, the sewn seams are not shown, and where they are shown, they are shown schematically. For example, lateral sewn seams are schematically illustrated by dashed lines in FIGS. 7-11. In the drawings in which sewn seams are shown, only single seams are shown in an effort to clarify the drawings. Notwithstanding, for the body 22 of the first exemplary embodiment, for each sewn seam shown in the drawings there is typically a pair of seams. For each pair of such seams, the two seams are typically spaced apart from one another and substantially parallel. Alternatively, any number of sewn seams may be used, and the sewn seams may be replaced with any other suitable foldable attachment mechanisms, such as seams formed by adhesive material, heat sealing, ultrasonic welding, or by any other suitable mechanism, depending on what type of textile material, or what type of any other suitable material, is used. As at least partially shown in FIGS. 7-11, fastener strips 38 and lateral sewn seams preferably (e.g., optionally) extend for substantially the entire width of the respective piece 44, 46, 48 of textile material. However, the fastener strips 38 and lateral sewn seams may be configured differently without departing from the scope of this disclosure.

Figure 12:
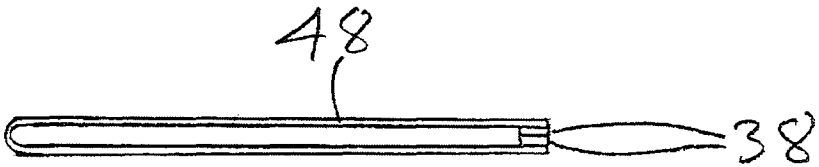
FIG. 12 is a side elevation view showing the item of FIG. 11 folded over to form a divider pocket precursor, in accordance with the first exemplary embodiment.

FIG. 12 is a side elevation view of the piece 48 of the representative divider panel folded over to partially form a divider pocket, wherein the fold substantially closes the rear end of the divider pocket, and the front end of the pocket is substantially closed by the mated pair of fastener strips 38. In contrast, the right and left sides of the divider pocket are open in FIG. 12.

Figure 13:
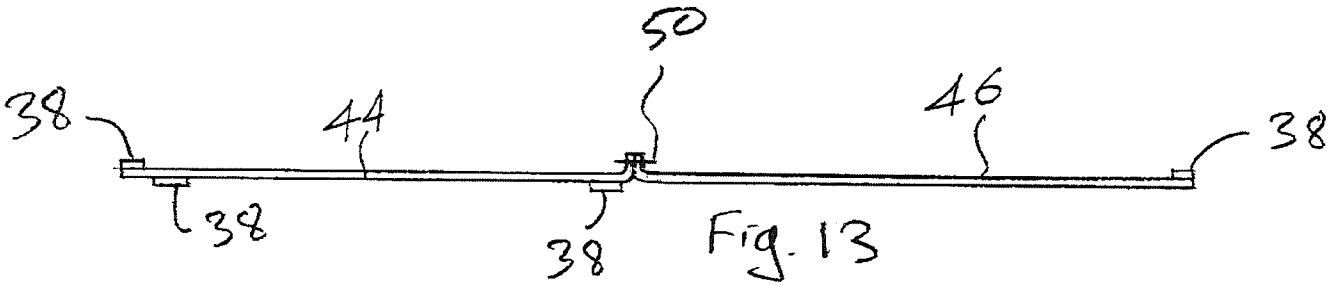
FIG. 13 is a view of a body pocket precursor formed by sewing together the inner and outer pieces of a FIGS. 7-10, in accordance with the first exemplary embodiment.

FIG. 13 is a view of a representative body pocket precursor comprising the inner and outer pieces 44, 46 of FIGS. 7-10 joined together by a lateral sewn seam 50. Preferably (e.g., optionally), the inner and outer pieces 44, 46 are substantially aligned with one another and the lateral sewn seam 50 extends for substantially the entire width of the outer and inner pieces 44, 46 of textile material. However, the fastener strips 38 and lateral sewn seam 50 may be configured differently without departing from the scope of this disclosure. As another alternative, the body pocket precursor may be formed from a single piece of textile material, such that the lateral sewn seam 50 may be omitted. That is, for each of the body panels 24, 26, 28, 30, rather than including the two pieces 44, 46, a single, longer piece of textile material may be used, similarly to the divider panels 40, and vice versa.

Figure 14:
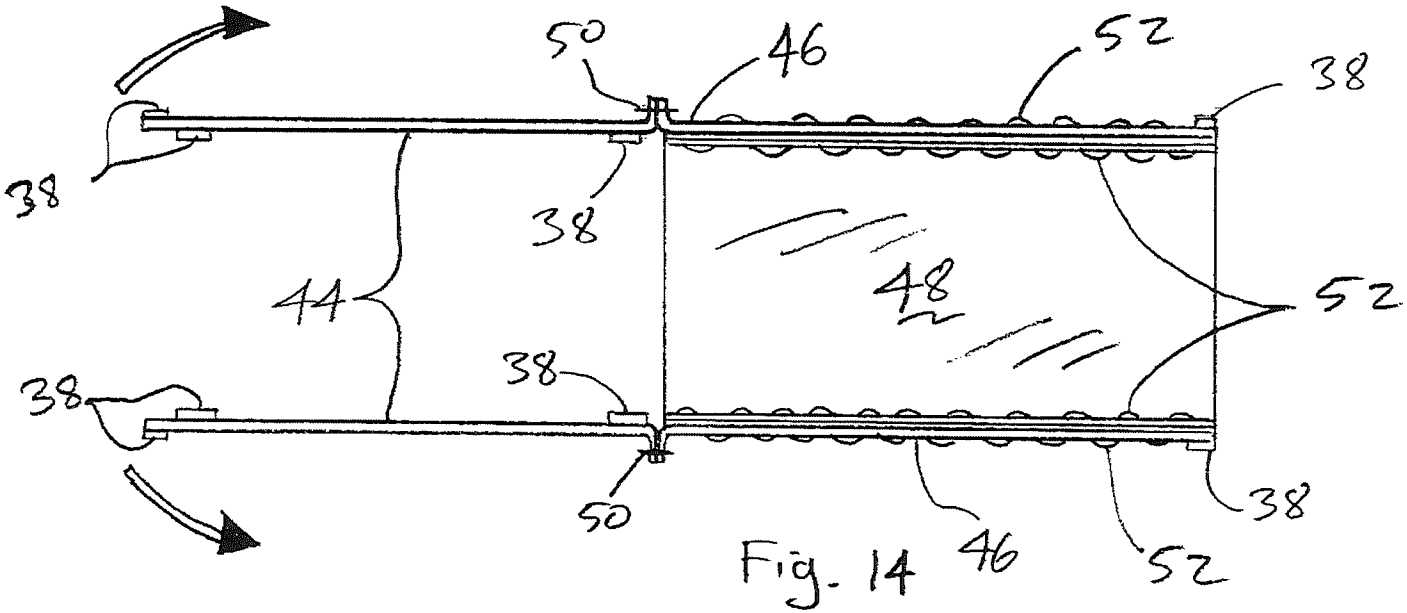
FIG. 14 shows the divider pocket precursor of FIG. 12 sewn between a pair of body pocket precursors of FIG. 13, in accordance with the first exemplary embodiment.

Generally described, FIG. 14 shows the divider pocket of FIG. 12 positioned between and sewn to two of the body pocket precursors of FIG. 13. More specifically, the opposite longitudinal margins of the folded piece 48 are folded about ninety degrees relative to the central portion of the folded piece 48, and the longitudinal margins are connected to the inner pieces 46 of the body pocket precursors by schematically illustrated longitudinal sewn seams 52. The longitudinal sewn seams 52 substantially close the opposite sides of the divider pocket. As at least partially shown in FIG. 14, the longitudinal sewn seams 52 preferably (e.g., optionally) extend for substantially the entire length of the folded piece 48. However, the seams 52 may be configured differently without departing from the scope of this disclosure. FIG. 14 is representative of the pocket portion of each of the divider panels 40 being sewn between opposite inner pieces 46 of the right and left body pocket precursors.

With continued reference to FIG. 14 and as schematically illustrated by the arrows proximate the left ends of the body pocket precursors, similarly to the folded piece 48 of FIG. 12, each of the body pocket precursors is folded over to partially form a body pocket in which the outer piece 44 of the body pocket is in opposing face-to-face relation with the inner piece 46 of the body pocket, the fold substantially closes the rear end of the body pocket, and the front end of the body pocket is substantially closed by a mated pair of fastener strips 38. In contrast, the sides of the body pocket are open.

Figure 15:
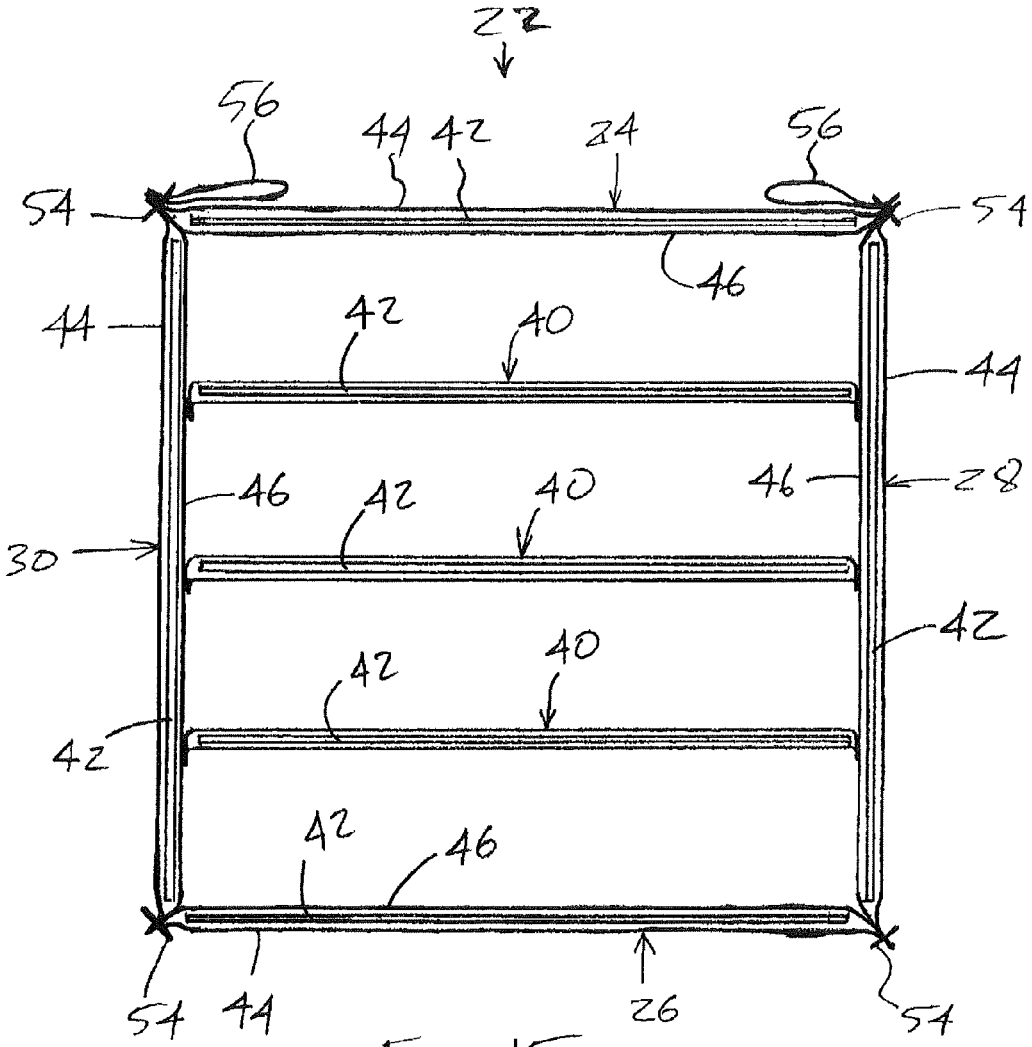
FIG. 15 is an isolated front elevation view of an assembled body of the tote with the pockets open and respectively containing stiffening panels.

Thereafter and as best understood with reference to FIG. 15, the opposite longitudinal margins of the partially formed body pockets are respectively connected to one another by schematically illustrated longitudinal sewn seams 54. The other sewn seams and fastener strips 38 are not shown in FIG. 15 in order to clarify the view.

The longitudinal sewn seams 54 substantially close the opposite sides of the body pockets. The longitudinal sewn seams 54 preferably (e.g., optionally) extend for substantially the entire length of the body 22. However, the seams 54 may be configured differently without departing from the scope of this disclosure.

For each of the upper two longitudinal sewn seams 54 at each of the ends of the body 22, the fastener strips 38 of the upper flaps 36 may be respectively attached to the outer fastener strips 38 of the top body panel 24 when the upper two longitudinal sewn seams 54 are formed, so that the upper two longitudinal sewn seams 54 securely connect the upper flaps 36, and thus the end assemblies 32, to the opposite ends of the top body panel 24. For example, FIG. 4 may be characterized as schematically illustrating that the upper flaps 36 of the end assemblies 32 are sewn to the body 22, since it is schematically shown in FIG. 4 that the upper flaps 36 (which are hidden from view in FIG. 4) remain attached to the upper fastener strips 38 of the top body panel 24 when the opposite ends of the body 22 are open.

Referring to FIG. 15, the tote 20 optionally may include one or more handles 56 formed, for example, by forming strips of textile material into partial loops, and sewing opposite ends of the partial loops to the top sides of the body 22 by way of the upper pair of longitudinal sewn seams 54, or the like. One or more of the handles 56 may be omitted or provided in any other suitable manner.

Immediately after the body and divider pockets are formed and substantially closed as discussed above, and before the stiffening panels 42 are respectively inserted in the pockets, the front opening of each of these pockets may remain substantially closed by the mated interaction of the inner fastener strips 38 of the pocket. As a general example, see the end of the divider panel being held closed by fastener strips 38 in FIG. 12, and the front openings of the pockets are schematically shown as being in their closed configurations in FIGS. 3 and 4. For completing the assembly of the body and divider panels 24, 26, 28, 30, 40, the front opening of each of the body and divider pockets may be opened by unmating the inner fastener strips 38 of the pocket. Then, the stiffening panels 42 may be respectively inserted into the interior of the pockets through their front openings, as generally shown in FIG. 15.

In the first exemplary embodiment, each of the pockets is substantially filled with a single one of the stiffening panels 42, although more than one of the stiffening panels may be included in each of the pockets, and in some situations one or more of the stiffening panels may be omitted. After inserting the stiffening panels 42, typically the front opening of each of the pockets is closed by causing mated interaction between the inner fastener strips 38 of the pocket. That is, the stiffening panels 42 are retained in the respective pockets by at least partially closing the front opening of the pockets.

In the first exemplary embodiment, the inner fastener strips 38 of each pocket extend for the entire width of the pocket, although they may extend to a lesser extent, and the stiffening panels 42 may be retained in their respective pockets in any other suitable manner. For example, alternatively the front openings of the pockets may be at least partially closed with sewn stitches or any other suitable fastening mechanisms.

Figure 16:
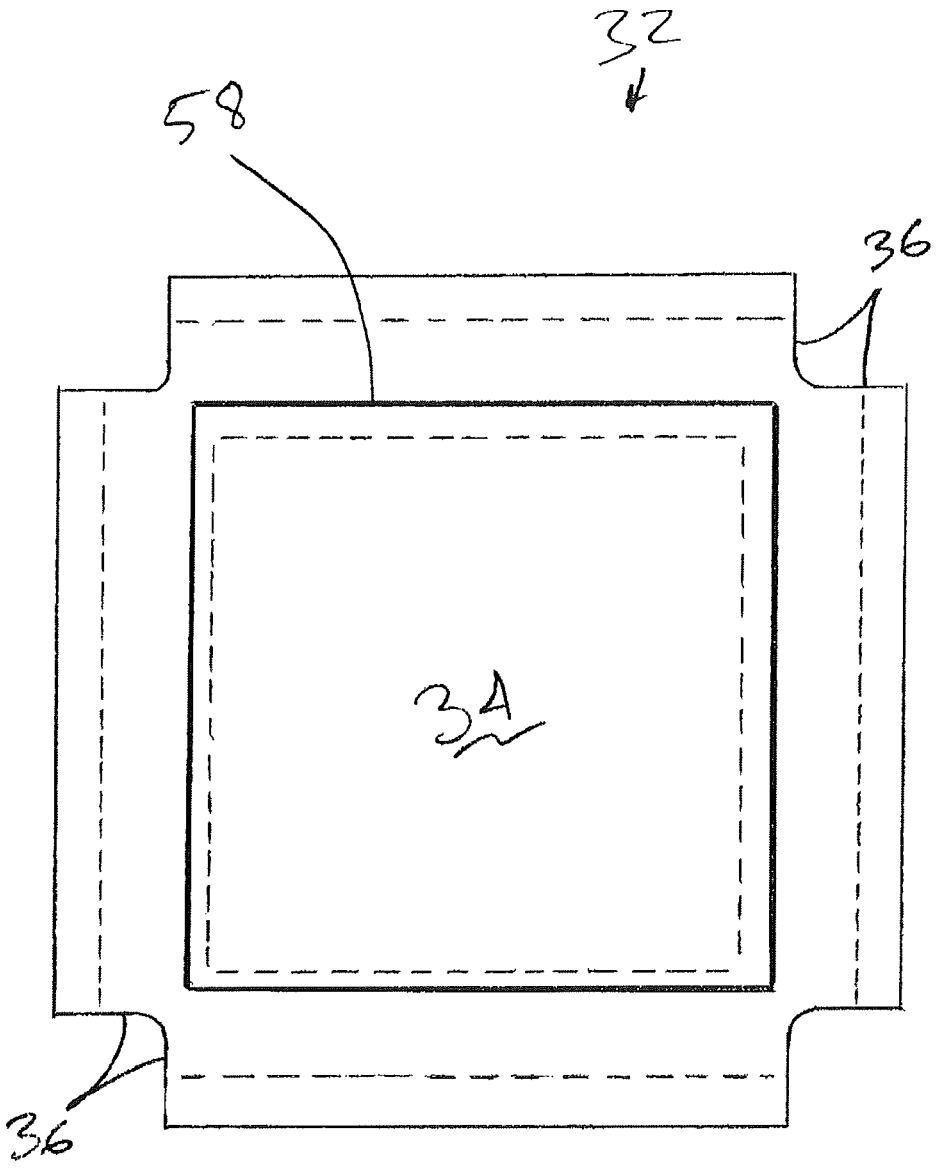
FIGS. 16 and 17 are isolated views of the outer and inner sides, respectively, of a representative one of end assemblies of the tote of FIG. 1.
Figure 17:
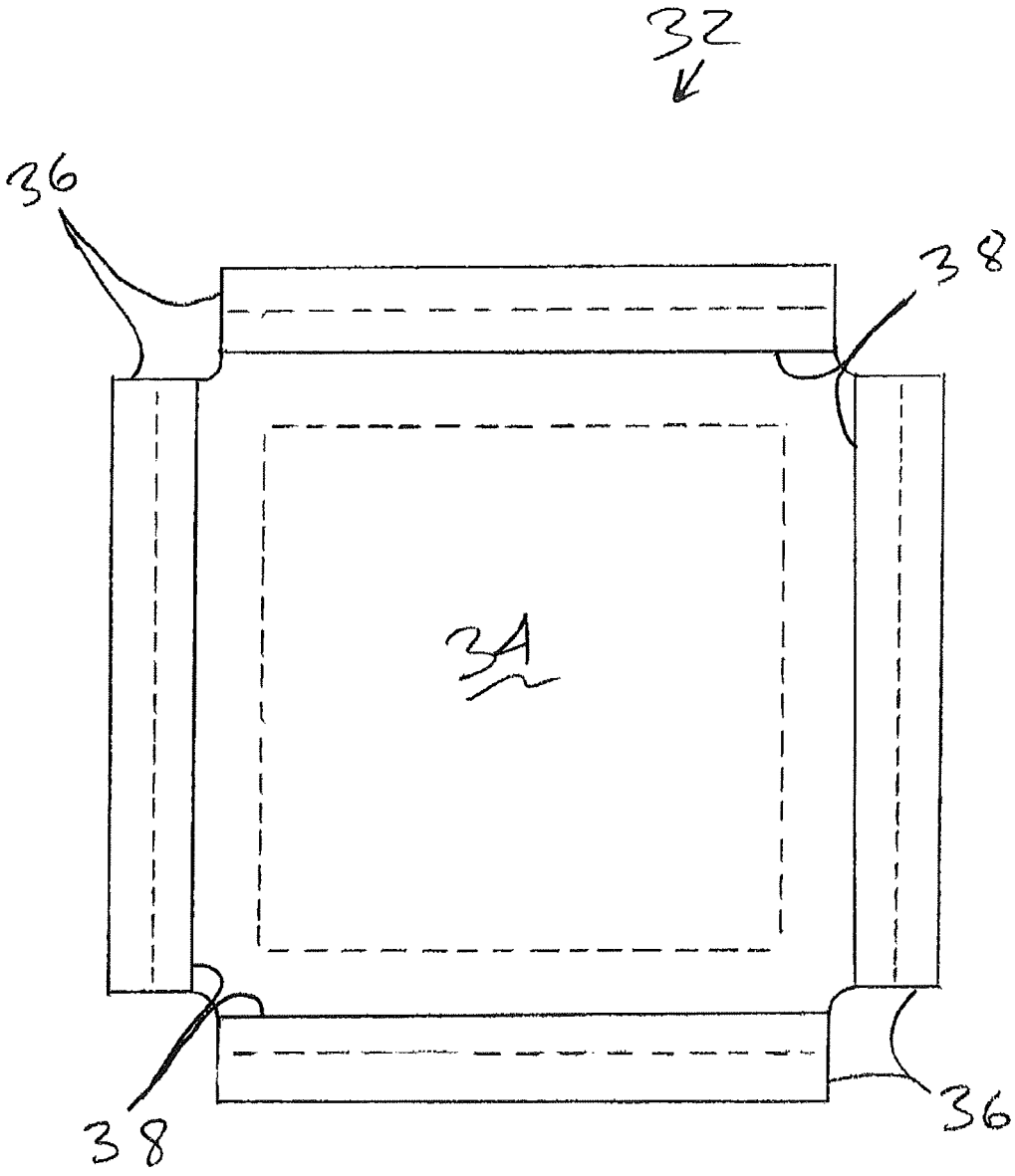
Figure 18:
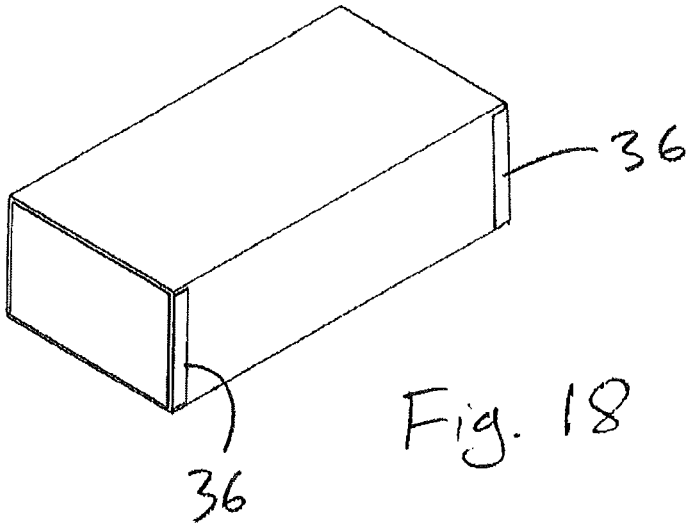
FIG. 18 is a top, front, right pictorial view of a shipping tote in an erected configuration with its ends closed, in accordance with a second exemplary embodiment of this disclosure.
Figure 19:
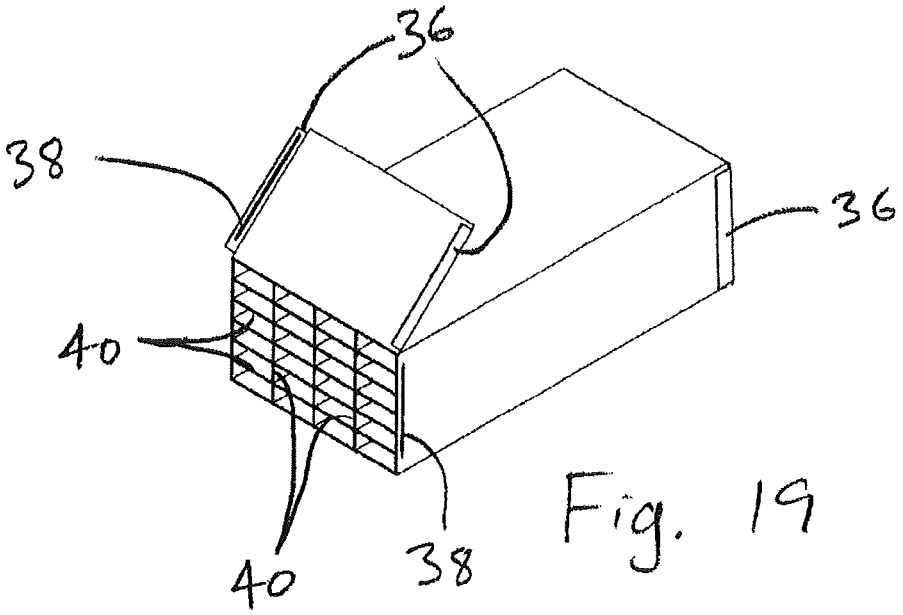
FIG. 19 is like FIG. 18, except that the front end of the shipping tote is open.
Figure 20:
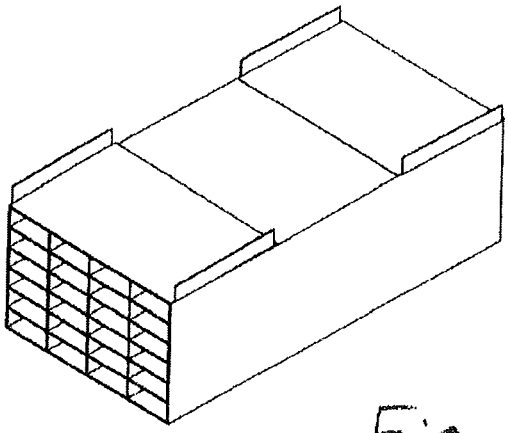
FIG. 20 is generally like FIG. 19, except that the rear end of the shipping tote is also open.
Figure 21:
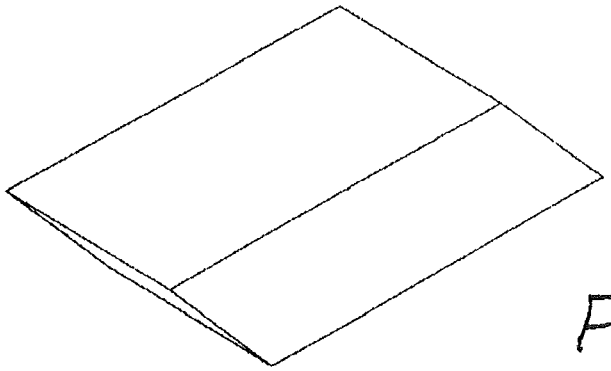
FIG. 21 is bottom view of the shipping tote of FIG. 18 in a collapsed configuration.

FIGS. 16 and 17 are isolated views of the outer and inner sides, respectively, of a representative one of the end assemblies 32 in a flat configuration. The representative end assembly includes one or more layers of textile material, which include the flaps 36, and to which a stiffening panel 58 is attached by a sewn seam. The seam connecting the stiffening panel 58 to the textile material of the end assembly 32, and the seams connecting the fastener strips 38 to the flaps 36, are schematically illustrated by dashed lines in FIGS. 16 and 18. In the first exemplary embodiment, the transition between the end panel 34 and flaps 36 is defined by the peripheral edge of the stiffening panel 58 and the seam connecting the stiffening panel to the textile material of the end assembly 32, and the connection between the end panel and the flaps is by virtue of the continuous nature of the textile material of the end assembly.

In an alternative embodiment, the stiffening panel 58 may be positioned in a pocket of the end panel 34, wherein the pocket may be defined by the textile material of the end assembly 32 and one or more appropriately configured sewn seams, or the like. Alternatively and similarly to the end assemblies 32, one or more of the stiffening panels 42 may be sewn to their adjacent textile material, such that rather than forming pockets and including the stiffening panels 42 in the pockets, the stiffening panels 42 may be sewn to the textile material of the respective panel.

In the first exemplary embodiment, for each of the end assemblies 32, the stiffening panel 58 is the outermost layer of the end assembly 32, the periphery of the stiffening panel 58 is about the same size as the periphery of the respective end opening of the body 22, and the stiffening panel 58 is sufficiently rigid for operating in conjunction with, for example, the rigid stiffening panels 42 to hold the tote 20 in the erected, open configuration shown in FIGS. 3.

The stiffening panels 42, 58 may be any suitable, generally rigid, plate-like pieces of materials. For example, in the first exemplary embodiment the stiffening panels 42, 58 are extruded corrugated sheets of polymeric (e.g., plastic) material, although they may be pieces of cardboard, sheet metal, or any other suitable material. The above-discussed pieces of textile material (e.g., fabric) may be any suitable types of textile material, such as, but not limited to, nonwoven or woven textile materials, and the textile materials may be coated with suitable coatings and/or may have suitable films or other suitable layers laminated thereto. In addition, each of the pieces of textile material may consist of a single layer of textile material or multiple layers of textile material optionally in combination with any other suitable layers.

As an example that is not shown in the drawings, the bottom body panel 26 may further include a durable outermost layer that is sewn or otherwise attached to the outer piece 44 of the bottom body panel 26 for reinforcement. This outermost layer may comprise textile material, polymeric film, extruded sheet, any other suitable material and/or any suitable combination thereof. Likewise, the other panels 24, 26, 28, 30, 40 and features of the tote 20 may be modified. For example and alternatively, in some situations the tote 20 may be made predominately of paperboard, cardboard and/or any other suitable materials.

Other variations are also within the scope of this disclosure. For example, the number of flaps 36 can be reduced, the number of divider panels 40 may be increased and/or the divider panels may be configured differently. For example, FIGS. 18-21 generally correspond to FIGS. 1 and 3-5, respectively, except that FIGS. 18-21 illustrate a tote of a second exemplary embodiment of this disclosure. The first and second exemplary embodiments are substantially the same except for variations noted and variations that will be apparent to one of ordinary skill in the art. For example, the tote of the second exemplary embodiment includes less flaps 36, and additional and differently configured divider panels 40. The divider panels 40 of the second exemplary embodiment each extend in the longitudinal direction and in directions crosswise to the longitudinal direction, wherein for some of the divider panels the crosswise direction is upright, and for other of the divider panels the crosswise direction is substantially horizontal.

The above examples are in no way intended to limit the scope of the present invention. It will be understood by those skilled in the art that while the present disclosure has been discussed above with reference to exemplary embodiments, various additions, modifications and changes can be made thereto without departing from the spirit and scope of the invention as set forth in the claims.

What is claimed is:

1. A collapsible shipping tote, comprising:

a body for extending around an interior space of the tote while the body is in an erected configuration, wherein the body comprises a plurality of body panels that are respectively foldably connected to one another so that the body can be reconfigured between the erected configuration and a collapsed configuration, and the body has opposite ends;

end assemblies, wherein each of the end assemblies is configured for being moved between an open configuration for at least partially opening a respective end of the body while the body is in the erected configuration, and a closed configuration for at least partially closing the respective end of the body while the body is in the erected configuration;

an end assembly of the end assemblies comprises an end panel and one or more flaps respectively foldably connected to edges of the end panel;

a plurality of fasteners for releasably securing the flaps to the body for at least partially releasably securing the body in the erected configuration; and at least one divider panel positioned in the interior space and foldable connected to the body for dividing the interior space into cells that are open at both of the opposite ends of the body while the body is in the erected configuration and each of the end assemblies is in the open configuration, wherein the at least one divider panel being foldably connected to the body is comprised of the at least one divider panel being connected to a body panel of the plurality of body panels by at least one sewn seam, and wherein the body and the at least one divider panel are cooperatively configured so that the at least one divider panel remains both foldably connected to the body and positioned in the interior space while each of the body is in the erected configuration, the body is in the collapsed configuration and the body is reconfigured between the erected and collapsed configurations.

2. The collapsible shipping tote according to claim 1, wherein:

each of the body panels comprises one or more pieces of textile material sewn together to form a pocket, and a stiffening panel positioned in the pocket.

3. The collapsible shipping tote according to claim 1, wherein the body panels being respectively foldably connected to one another comprises the body panels being respectively connected to one another by sewn seams.

4. The collapsible shipping tote according to claim 1, wherein:

each of the fasteners is a hook-and-loop fastener comprising strips of textile material respectively comprising hooks and loops; and the strips of textile material are respectively sewn to the body and the flaps.

5. The collapsible shipping tote according to claim 1, wherein:

the at least one divider panel comprises one or more pieces of textile material sewn together to form a pocket, and a stiffening panel positioned in the pocket.

6. The collapsible shipping tote according to claim 1, wherein:

the opposite ends are opposite front and rear ends;

the opposite front and rear ends of the body are spaced apart from one another in a longitudinal direction; and the at least one divider panel comprises a plurality of divider panels that each extend in the longitudinal direction, and in a direction crosswise to the longitudinal direction.

7. The collapsible shipping tote according to claim 6, wherein;

the direction crosswise to the longitudinal direction is substantially horizontal; and the at least one divider panel further comprises a plurality of divider panels that each extend upright and in the longitudinal direction.

8. The collapsible shipping tote according to claim 1, wherein:

an end panel of the end assembly comprises a stiffening panel mounted to at least one piece of textile material, and the flaps of the end assembly comprise portions of the at least one piece of textile material.

9. The collapsible shipping tote according to claim 1, wherein the at least one divider panel comprises:

one or more pieces of textile material sewn together to form a pocket, and a stiffening panel positioned in the pocket.

10. The collapsible shipping tote according to claim 1, wherein:

the plurality of body panels includes opposite first and second body panels;

the at least one divider panel includes opposite first and second margins; and the at least one divider panel being foldably connected to the body is comprised of the first margin being connected to a central portion of the first body panel by the at least one sewn seam, and the second margin being connected to a central portion of the second body panel by at least one sewn seam.

11. The collapsible shipping tote according to claim 1, wherein:

the at least one sewn seam comprises a first sewn seam;

the plurality of body panels includes opposite first and second body panels;

each of the first and second body panels comprises one or more pieces of material sewn together to form a pocket, the one or more pieces of material comprising inner and outer pieces of material, and a stiffening panel positioned in the pocket between the inner and outer pieces of material;

the at least one divider panel comprises a divider panel having opposite first and second portions;

the at least one divider panel being foldably connected to the body is comprised of the first portion of the divider panel being connected to a central portion of the inner piece of the first body panel by at least the first sewn seam, and the second portion of the divider panel being connected to a central portion of the inner piece of the second body panel by at least a second sewn seam;

the stiffening panel of the first body panel is positioned between the first sewn seam and the outer piece of material of the first body panel; and the stiffening panel of the second body panel is positioned between the second sewn seam and the outer piece of material of the second body panel.

12. The collapsible shipping tote according to claim 11, wherein the divider panel comprises a pocket having opposite sides that are respectively substantially closed by the first and second sewn seams.

13. The collapsible shipping tote according to claim 11, wherein for each body panel of the first and second body panels, the inner and outer pieces of material are parts of a single piece of textile material,

14. The collapsible shipping tote according to claim 11, wherein:

the divider panel is a first divider panel;

the at least one divider panel further comprises a second divider panel having opposite first and second margins;

the at least one divider panel being foldably connected to the body is further comprised of the first margin of the second divider panel being connected to the inner piece of the first body panel by at least a third sewn seam, and the second margin of the second divider panel being connected to the inner piece of the second body panel by at least a fourth sewn seam;

the stiffening panel of the first body panel is positioned between the third sewn seam and the outer piece of material of the first body panel;

the stiffening panel of the second body panel is positioned between the fourth sewn seam and the outer piece of material of the second body panel;

the first and second divider panels are spaced apart from one another while the body is in the erected configuration; and at least one cell of the cells is positioned between the first and second divider panels, and the first and second divider panels are substantially parallel to one another.

15. A collapsible shipping tote, comprising:

a body having opposite ends and further comprising:

a plurality of body pockets for extending around an interior space of the tote while the body is in an erected configuration, wherein the body pockets are respectively foldably connected to one another so that the body can be reconfigured between the erected configuration and a collapsed configuration, and for each body pocket of the plurality of body pockets, the body pocket comprises one or more pieces of textile material sewn together to form the body pocket, and a plurality of stiffening panels, wherein the stiffening panels are respectively positioned in the body pockets;

end assemblies, wherein each of the end assemblies comprises an end panel and one or more flaps respectively foldably connected to edges of the end panel, and each of the end assemblies is configured for being moved between an open configuration for at least partially opening a respective end of the body while the body is in the erected configuration, and a closed configuration for at least partially closing the respective end of the body while the body is in the erected configuration;

a plurality of fasteners for releasably securing the flaps to the body for releasably securing the body in the erected configuration; and at least one divider panel positioned in the interior space and foldably connected to the body for dividing the interior space into cells that are open at both of the opposite ends of the body while the body is in the erected configuration and each of the end assemblies is in the open configuration, wherein the at least one divider panel comprises a divider pocket and a stiffening panel positioned in the divider pocket, the divider pocket comprises one or more pieces of textile material sewn together to form the divider pocket, and the body and the at least one divider panel are cooperatively configured so that the at least one divider panel remains both foldably connected to the body and positioned in the interior space while each of the body is in the erected configuration, the body is in the collapsed configuration, and the body is reconfigured between the erected and collapsed configurations.

16. The collapsible shipping tote according to claim 15, wherein the body pockets being respectively foldably connected to one another comprises the body pockets being respectively connected to one another by sewn seams.

17. The collapsible shipping tote according to claim 15, wherein:

each of the fasteners is a hook-and-loop fastener comprising strips of textile material respectively comprising hooks and loops; and the strips of textile material are respectively sewn to the body and the flaps.

18. The collapsible shipping tote according to claim 15, wherein for an end assembly of the end assemblies:

an end panel of the end assembly comprises a stiffening panel mounted to at least one piece of textile material, and the flaps of the end assembly comprise portions of the at least one piece of textile material.

19. The collapsible shipping tote according to claim 15, wherein the at least one divider panel being foldably connected to the body is comprised of:

the at least one divider panel being connected to a first body pocket of the plurality of body pockets by at least one sewn seam; and the at least one divider panel being connected to a second body pocket of the plurality of body pockets by at least one sewn seam.

20. The collapsible shipping tote according to claim 15, wherein:

the plurality of body pockets includes opposite first and second body pockets;

the at least one divider panel includes opposite first and second margins; and the at least one divider panel being foldably connected to the body is comprised of the first margin being connected to a central portion of the first body pocket by at least one sewn seam, and the second margin being connected to a central portion of the second body pocket by at least one sewn seam.

21. The collapsible shipping tote according to claim 15, wherein:

the plurality of body pockets includes opposite first and second body pockets;

for each body pocket of the first and second body pockets the one or more pieces of material of the body pocket comprise inner and outer pieces of material, and the respective stiffening panel is positioned in the body pocket between the inner and outer pieces of material;

the at least one divider panel comprises a divider panel having opposite first and second margins;

the at least one divider panel being foldably connected to the body is comprised of the first margin being connected to a central portion of the inner piece of the first pocket by a first sewn seam, and the second margin being connected to a central portion of the inner piece of the second pocket by at least a second sewn seam;

the stiffening panel of the first pocket is positioned between the first sewn seam and the outer piece of material of the first pocket; and the stiffening panel of the second pocket is positioned between the second sewn seam and the outer piece of material of the second pocket.

22. A method of forming a collapsible shipping tote, comprising:

forming a body having opposite ends and further comprising a plurality of body pockets for extending around an interior space of the tote while the body is in an erected configuration, wherein the body pockets are respectively foldably connected to one another so that the body can be reconfigured between the erected configuration and a collapsed configuration, and the forming is comprised of sewing textile material;

attaching end assemblies to the body, wherein each of the end assemblies comprises an end panel and one or more flaps respectively foldably connected to edges of the end panel, and each of the end assemblies is configured for being moved between an open configuration for at least partially opening a respective end of the body while the body is in the erected configuration, and a closed configuration for at least partially closing the respective end of the body while the body is in the erected configuration;

attaching a divider pocket in the interior space for dividing the interior space into cells that are open at both of the opposite ends of the body while the body is in the erected configuration and each of the end assemblies is in the open configuration, wherein the plurality of body pockets includes opposite first and second body pockets, the attaching of the divider pocket is comprised of sewing a first portion of the divider pocket to an inner piece of the first body pocket, and sewing a second portion of the divider pocket to an inner piece of the second body pocket, the forming of the body is comprised of sewing an outer piece of the first body pocket to the inner piece of the first body pocket after the sewing of the first portion of the divider pocket to the inner piece of the first body pocket, and the forming of the body is comprised of sewing an outer piece of the second body pocket to the inner piece of the second body pocket after the sewing of the second portion of the divider pocket to the inner piece of the second body pocket;

inserting a plurality of stiffening panels so that the stiffening panels are respectively positioned in the body pockets, comprising inserting a first stiffening panel of the plurality of stiffening panels into the first body pocket after both the sewing of the first portion of the divider pocket to the inner piece of the first body pocket, and the sewing of the outer piece of the first body pocket to the inner piece of the first body pocket, and inserting a second stiffening panel of the plurality of stiffening panels into the second body pocket after both the sewing of the second portion of the divider pocket to the inner piece of the second body pocket and, the sewing of the outer piece of the second body pocket to the inner piece of the second body pocket; and retaining the stiffening panels in the body pockets by at least partially closing the body pockets.

23. The method according to claim 22, further comprising:

opening a front opening of the divider pocket after the attaching of the divider pocket in the interior space, the opening of the front opening being comprised of unmating fasteners from one another;

then inserting a third stiffening panel in the divider pocket; and then retaining the third stiffening panel in the divider pocket, comprising at least partially closing the front opening of the divider pocket, comprising mating the fasteners to one another.

24. The method according to claim 22, further comprising:

opening a front opening of the first body pocket after the sewing of the outer piece of the first body pocket to the inner piece of the first body pocket, the opening of the front opening being comprised of unmating fasteners;

retaining the first stiffening panel in the first body pocket, comprising at least partially closing the front opening of the first body pocket.

25. The method according to claim 22, wherein for each body pocket of the first and second body pockets, the inner and outer pieces of material are parts of a single piece of textile material.

* * * * *